United States Patent [19]

Lowe et al.

[11] Patent Number: 4,773,239

[45] Date of Patent: Sep. 27, 1988

[54] COMBINATION SKATEBOARD LOCK AND TRICK DEVICE

[76] Inventors: Gordon M. Lowe; Patrice P. Lowe, both of 384 E. Canyon Country Rd., Brea, Calif. 92621

[21] Appl. No.: 7,736

[22] Filed: Jan. 28, 1987

[51] Int. Cl.[4] ..... E05B 67/22

[52] U.S. Cl. ..... 70/38 A; 70/39; 70/58; 280/11.2; 280/87.04 A

[58] Field of Search ..... 70/38 A, 38 R, 39, 57, 70/58, 35, 1, 18; 280/11.15, 11.2, 87.04, 87.04 A, 87.05, 218, 221

[56] References Cited

U.S. PATENT DOCUMENTS

| | | | |
|---|---|---|---|
| 1,223,928 | 4/1917 | Benson | 70/39 |
| 1,283,493 | 11/1918 | Garner | 70/38 R |
| 1,308,458 | 7/1919 | Voight | 70/38 A X |
| 1,379,120 | 5/1921 | Miller | 70/39 |
| 1,461,725 | 7/1923 | Cooper | 70/39 X |
| 1,618,924 | 2/1927 | Hanton | 70/39 X |
| 1,690,938 | 11/1928 | Maxwell | 70/38 A X |
| 2,066,393 | 1/1937 | Dials | 70/39 |
| 2,924,960 | 2/1960 | Palazzo | 70/39 X |
| 3,634,963 | 1/1972 | Hermann | 70/58 X |
| 3,636,739 | 1/1972 | Smedley | 70/39 |
| 3,670,535 | 6/1972 | Stettner et al. | 70/58 |
| 3,765,197 | 10/1973 | Foote | 70/58 |
| 3,990,713 | 11/1976 | Hokanson | 280/11.2 X |
| 4,038,845 | 8/1977 | Szlakman | 70/38 A X |
| 4,055,234 | 10/1977 | Burton | 280/11.2 X |
| 4,183,547 | 1/1980 | Cohen et al. | 280/87.04 A |
| 4,251,087 | 2/1981 | Hansen | 280/87.04 A X |
| 4,398,735 | 8/1983 | Evans et al. | 280/87.04 A X |

FOREIGN PATENT DOCUMENTS

| | | | |
|---|---|---|---|
| 1325433 | 3/1963 | France | 70/57 |

*Primary Examiner*—Gary L. Smith
*Assistant Examiner*—Suzanne L. Dino
*Attorney, Agent, or Firm*—Francis X. LoJacono

[57] ABSTRACT

A lock and trick device particularly designed for mounting to a skateboard in order to lock the skateboard to a fixed structure such as a bicycle rack or post, wherein the device comprises a lock body member which is fixedly mounted between the board of the skateboard and one of the wheel truck assemblies, the lock body being provided with a pair of oppositely disposed longitudinal bars to receive leg members of an adjustable U-shaped shackle, the looped end of which is bent at right angles to the legs thereof, thereby forming a trick handle.

12 Claims, 2 Drawing Sheets

COMBINATION SKATEBOARD LOCK AND TRICK DEVICE

BACKGROUND OF THE INVENTION

1. Field of the Invention

This invention relates generally to a lock device, and more particularly to a skateboard lock including a shackle designed to define a trick handle whereby the skateboard rider can perform various tricks during the use thereof.

2. Description of the Prior Art

There is lacking in the art a suitable means for preventing unauthorized use or theft of skateboards left unattended. One particular problem that exists is skateboards being stolen from children at school. Due to the cost of providing the means and also the designation of restricted areas for protecting numerous skateboards, many shool officials have banned the use of skateboards as a means of transportation to and from school. However, some schools which now prohibit the bringing of skateboards to school will allow students to do so if they can provide their own individual means for simply locking their skateboards to existing structures such as bicycle racks that are generally provided by all schools.

Hence, to the applicants' knowledge there is no existing provision for a lock means adapted for skateboards that is suitable for such use or use with other types of fixed structures.

As examples of lock devices, the following United States patents are listed. However, it should be noted that these prior-art devices are generally associated with bicycle or like vehicles.

U.S. Pat. No. 3,800,570 is a locking mechanism having a shackle that includes a movable bolt adapted to extend between the legs of the shackle and the lock therewith by means of a separate padlock and is not fixedly mounted or secured to the bicycle.

U.S. Pat. No. 3,805,564 is also a lock unit for a bicycle or motorcycle which is particularly suited for securing such to a fixed post, and for locking the wheels of said vehicle. The device consists of a U-shaped shackle member. One or more pairs of locking holes are located in one leg of the shackle and oriented at right angles to the axis of the shackle leg, beign spaced apart and of the diameter to receive a U-shaped hasp of a conventional lock.

U.S. Pat. No. 4,135,374 discloses a bicycle lock having a two-piece locking device comprising a clevis and a link, wherein the clevis has a pair of mutually orthogonal eyelets at its open end, and the link is adapted to be placed first over each eyelet out of the plane of the clevis and then over the eyelet in that plane. A padlock may be positioned with its shackle through the second eyelet to secure the clevis and link in locked engagement with one another.

U.S. Pat. No. 4,256,322 discloses a combination carrying and locking device for a cycle.

SUMMARY OF THE INVENTION

The present invention comprises a lock device adapted to be mounted to a skateboard, preferably adjacent the front thereof. The device includes a lock body member which is interposed between the skateboard and one of the wheel truck assemblies. Preferably, the lock is mounted adjacent the front wheel truck assembly.

There is a looped locking member defined by a shackle having a pair of locking arms which are received in the lock body member and adjustably locked into position therein by a lock mechanism. Various fixed structure members may be received through the loop of the shackle. The loop of the shackle is bent at right angles to the leg members thereof to establish a handle whereby the rider of the skateboard can readily perform various trick maneuvers.

Thus, the present invention has for an important object to provide a skateboard lock that until now has not been contemplated in the art of locks.

It is another object of the invention to provide a skateboard lock device that includes a trick handle arrangement of the shackle to allow the operator of the skateboard a means to readily perform various trick maneuvers while riding the board.

It is still another object of the invention to provide a lock device of this type wherein the shackle member may be used in one of two positions to accommodate for locking the board to different types and configurations of fixed structures.

It is a further object of the invention to provide a lock device of this character having relatively few operating parts.

It is still a further object of the invention to provide a device of this character that is relatively inexpensive to manufacture, and that is easy to service and maintain.

A still further object of the present invention is to provide a skateboard lock and trick device that is simple yet rugged in construction.

The various features of novelty which characterize the invention are pointed out with particularity in the claims annexed to and forming a part of this disclosure. For a better understanding of the invention, its operating advantages by its use, reference should be had to the accompanying drawings and descriptive matter.

BRIEF DESCRIPTION OF THE DRAWINGS

The objects and features of the present invention will be further understood with reference to the following detailed description of an illustrative embodiment of the invention, taken together with the accompanying drawings in which.

DESCRIPTION OF THE PREFERRED EMBODIMENT

Figure 1:
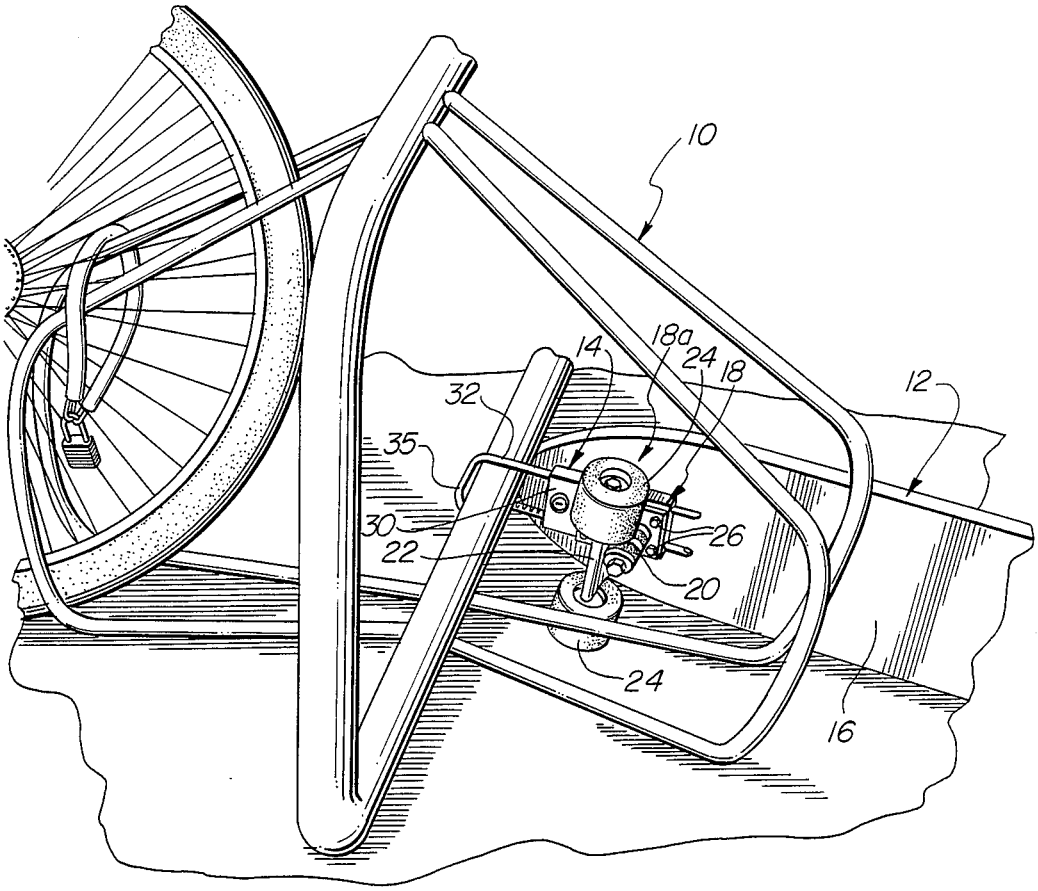
FIG. 1 is a pictorial view of the skateboard secured by means of the lock device to a fixed structure defined by a bicycle rack.

Referring more particularly to FIG. 1, there is pictorially illustrated a fixed structure defined as a bicycle rack, generally indicated at 10. Securely attached to the rack is a skateboard, designated by numeral 12, to which the present invention, a lock device 14, is fixedly mounted to the underside thereof.

Skateboards are well known in the art as toys as well as sporting equipment, but they are often used as a means of transportation. A typical skateboard generally comprises an elongated board 16 of various lengths and widths to which a pair of wheeled trucks, indicated generally at 18, are attached. The front truck assembly is indicated at 18*a* and the rear truck assembly is indicated at 18*b*. Each truck assembly comprises a truck frame 20 including axle 22 on which is mounted a pair of wheels 24. The truck assemblies are mounted normally to the underside of board 16, either directly to the board or with a spacer block (not shown) between the board and the truck by securing means such as nuts and bolts 26 and 27, respectively.

Figure 3:
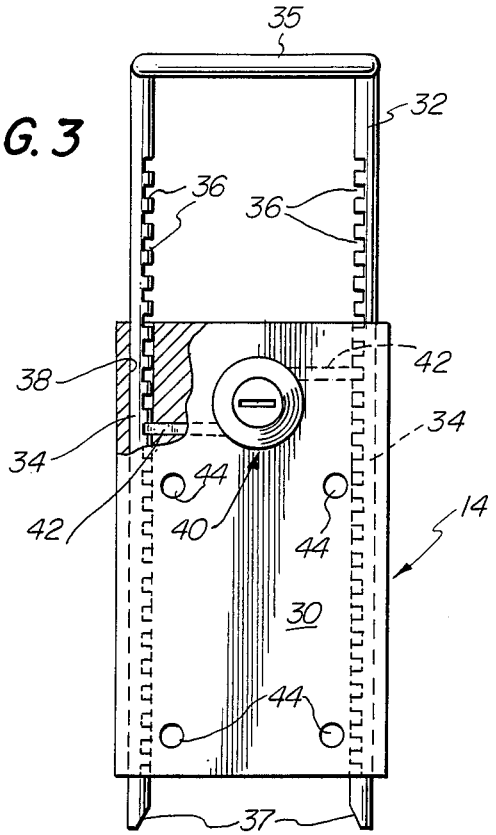
FIG. 3 is a front-elevational view with a partial section broken away to illustrate the shackle member in a secure locked position.
Figure 5:
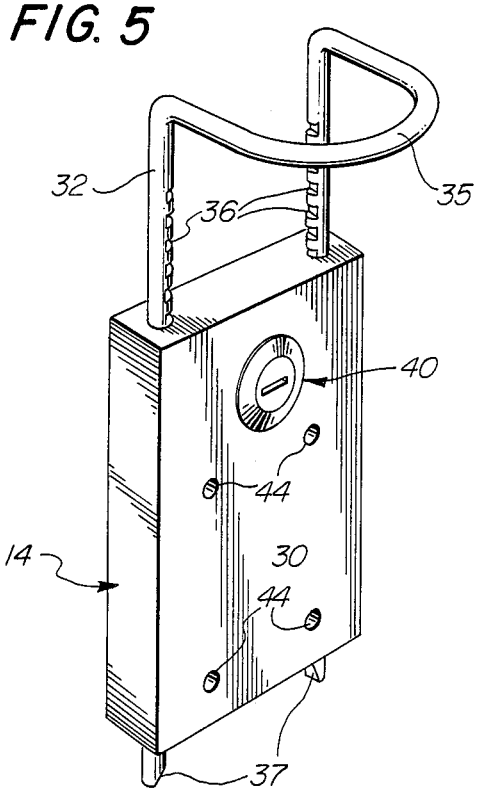
FIG. 5 is a perspective view of the lock device.
Figure 4:
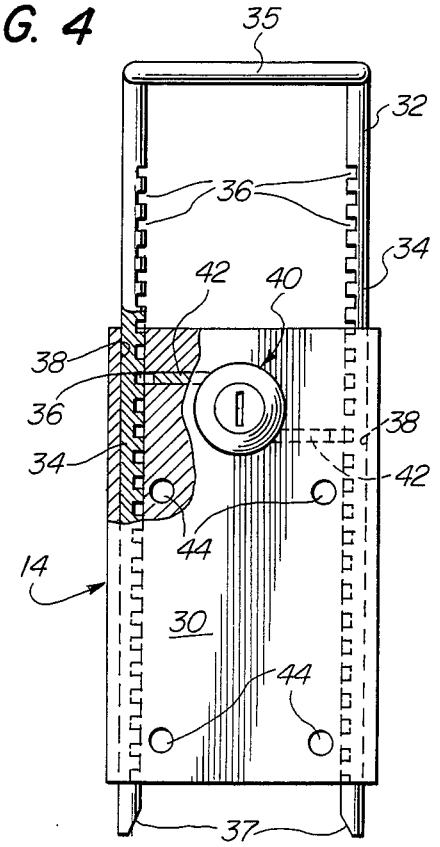
FIG. 4 is also a front-elevational view thereof showing the shackle member in an unlocked position.
Figure 6:
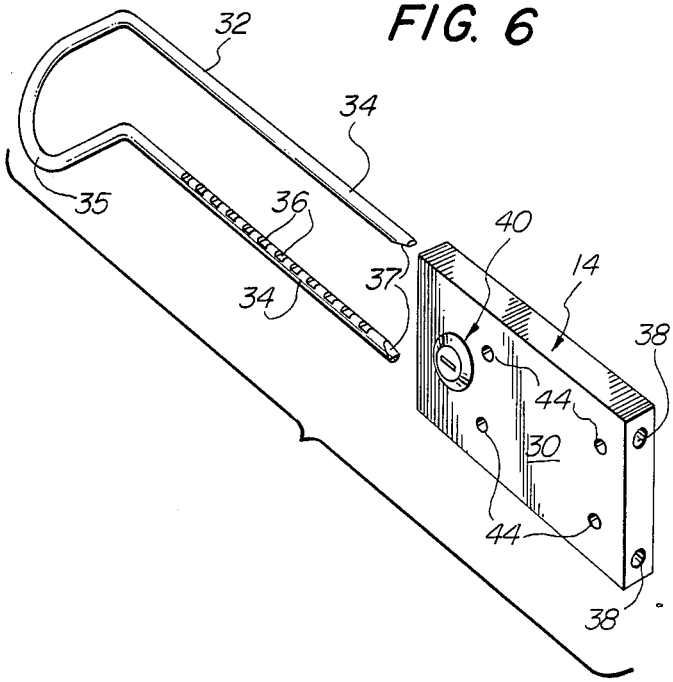
FIG. 6 is an exploded view of the present invention with the shackle separated from the lock body member.

Due to their inherent design, skateboards have not been easily adapted to be secured from theft so that they can not be readily left unattended. Accordingly, there is provided the present lock device 14 which comprises a lock block or body member 30 and a shackle member 32. The shackle member is formed as a U-shaped member having a pair of oppositely disposed leg members 34 which are integrally formed by means of a looped end 35 which is bent at right angles to legs 34. Bent loop 35 defines and provides a means for securely locking body member 30 to various types and configurations of fixed structures such as bars or pipes, as seen in FIG. 1, and further provides means for the skateboard user to perform various trick maneuvers while riding the board. Each leg member 34 includes a plurality of notches 36 formed along the inner side thereof and approximately the full length of each leg member from the looped end to each free beveled end 37. Leg members 34 are spaced apart so as to be received in corresponding longitudinal bores 38, as clearly illustrated in FIGS. 3 and 4. Preferably, a suitable key-locking device would be mounted in lock body 30 in which slidable locking pins 42 are arranged and positioned so as to engage aligned notches 36 of the oppositely disposed leg members 32. FIG. 3 illustrates the locking pins 42 as engaged in notches 36; while FIG. 4 shows locking pins 42 retracted so as to allow free movement of shackle 32.

Figure 2:
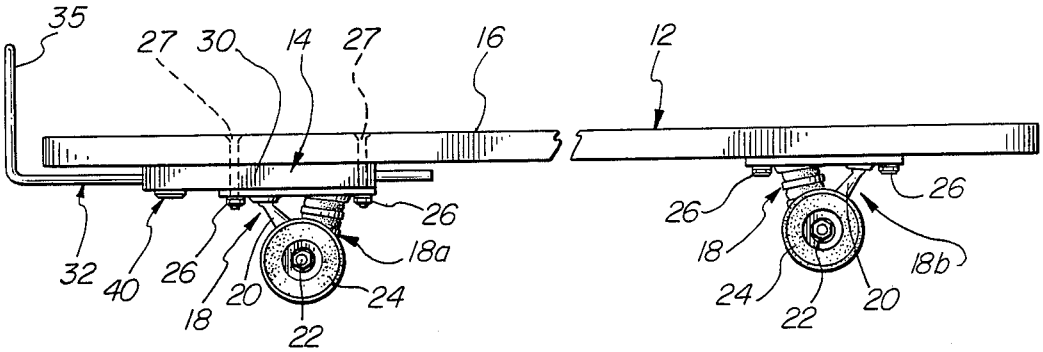
FIG. 2 is a side-elevational view of the present invention mounted in the preferred arrangement with that of a skateboard.

Lock body 30 is preferably mounted to the front of board 16 and interposed between the bottom of the board and truck assembly 18*a*, as illustrated in FIGS. 1 and 2. Accordingly, lock body 30 is provided with a plurality of mounting holes 44 through which bolt members 27 are received. In order to prevent the removal of bolts 27, typical non-removable nuts and bolts are employed.

It should also be understood that shackle 32 can be suitably positioned in lock body 30, whereby bent end 35 can project either upwardly above board 16, as shown in FIG. 2, or downwardly below the board in order to accommodate any particular fixed structure.

However, when positioned in an upward direction, loop end 35 can then be employed as a trick handle which allows the operator of the skateboard to grab the loop and thus perform various trick maneuvers by pulling up on the front of the skateboard.

The foregoing is a description of a preferred embodiment of the invention which is given here by way of example only. The invention is not to be taken as limited to any of the specific features as described, but comprehends all such variations thereof as come within the scope of the appended claims.

What we claim is:

1. In combination, a skateboard having a lock and trick device comprising:

a lock body member having a pair of oppositely disposed longitudinal bores;

a skateboard having an upper surface to which said lock body member is mounted thereon;

a U-shaped shackle member having a pair of oppositely disposed leg members, said legs being joined at one end by a closed loop member and the opposite end thereof being free to be received in corresponding bores of said lock body;

said shackle extending above the skateboard upper surface to allow the operator of said skateboard to perform trick maneuvers therewith;

locking means mounted in said lock body and positioned therein to lockingly engage each of said leg members; and means for securing said lock body to said skateboard.

2. The combination as recited in claim 1, wherein said closed loop end is bent at right angles to said leg members.

3. The combination as recited in claim 2, wherein said trick means is defined by said closed loop end of said U-shaped shackle.

4. The combination as recited in claim 3, wherein said closed loop end of said U-shaped shackle defines a trick handle when said loop end is positioned to extend above the upper surface of the skateboard on which said device is mounted, allowing said skateboard to be secured to a fixed structure.

5. The combination as recited in claim 1, wherein said device is positioned between said skateboard and one of the wheeled trucks thereof.

6. The combination as recited in claim 4, wherein said skateboard includes a front and rear truck assembly, wherein said device is mounted between said skateboard and said front truck assembly, and wherein said U-shaped shackle is adapted to lock in said lock body whereby said loop end of said shackle may be positioned to extend below said skateboard so as to allow said skateboard to be secured to a fixed structure.

7. In combination, a skateboard including a skateboard lock comprising:

a skateboard having an upper surface and a peripheral surface, and further having a front and rear wheel truck assembly mounted to the underside thereof;

a lock means comprising a lock body and a U-shaped shackle adjustably lockable in said lock body;

said lock body being mounted to one of said front or rear truck assemblies of said skateboard with said U-shaped shackle extending past the peripheral surface thereof, whereby said U-shaped shackle can be secured to a fixed structure to prevent unauthorized use of said skateboard.

8. The combination as recited in claim 7, wherein said U-shaped shackle comprises:

a pair of oppositely disposed leg members, each of said leg members being joined at one end by a closed loop member, and each of the opposite ends thereof being formed as an open free end, and wherein said lock body includes a pair of longitudinal bores positioned to lockingly receive said leg members of said shackle;

locking means mounted in said lock body for locking engagement with said leg members;

means for securing said lock body to said skateboard.

9. The combination as recited in claim 8, wherein said loop end of said shackle is bent at right angles to said leg members.

10. The combination as recited in claim 9, wherein said bent loop end of said shackle defines a trick means whereby the operator of said skateboard performs various tricks while riding said skateboard.

11. The combination as recited in claim 10, wherein said trick means defines a handle when said bent loop end is positioned to extend above said skateboard.

12. The combination as recited in claim 9, wherein said lock device is mounted between said skateboard and one of said wheel truck assemblies.

* * * * *